United States Patent [19]

Bevins

[11] 4,071,026

[45] Jan. 31, 1978

[54] INTRA-ORAL FILTERING DEVICE

[76] Inventor: Jesse Althen Bevins, 1532 E. 59th St., Chicago, Ill. 60637

[21] Appl. No.: 655,418

[22] Filed: Feb. 5, 1976

[51] Int. Cl.[2] ..... A62B 23/02

[52] U.S. Cl. ..... 128/147; 128/136; 128/208

[58] Field of Search ..... 128/147, 139, 140 R, 128/140 N, 141 R, 146 R, 146.2, 146.6, 206, 201, 195, 205, 146.5

[56] References Cited

U.S. PATENT DOCUMENTS

| | | | |
|---|---|---|---|
| 2,104,016 | 1/1938 | Biggs | 128/146.5 |
| 3,731,678 | 5/1973 | Pyzel | 128/147 |
| 3,889,671 | 6/1975 | Baker | 128/140 N |

*Primary Examiner*—Robert W. Michell

*Assistant Examiner*—Henry J. Recla

*Attorney, Agent, or Firm*—Emrich, Root, O'Keeffe & Lee

[57] ABSTRACT

An intra-oral filtering device for filtering and removing noxious materials from the air during the breathing process includes a housing having a cavity portion therein which contains a filter material for removing noxious materials from the air during the breathing process. The housing includes a mouth-piece portion and an exit portion communicating with the cavity portion to provide a path of travel for the air during the breathing process. The exit portion includes an unidirectional valve cover which permits purified air to pass through the intra-oral filtering device and which prevents saliva and expelled air from entering the intra-oral device through the exit portion.

4 Claims, 7 Drawing Figures

FIG. 1
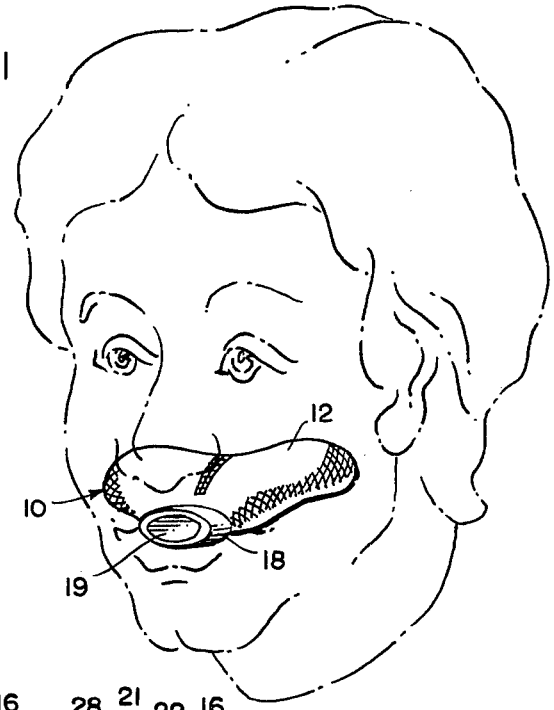
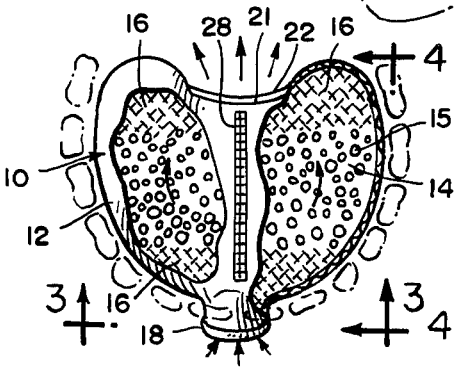
FIG. 2
FIG. 3
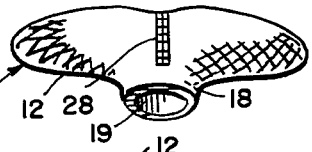
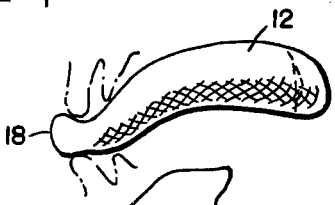
FIG. 4
FIG. 5
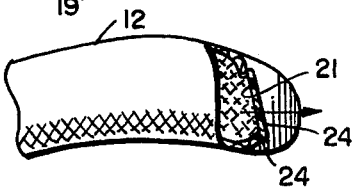
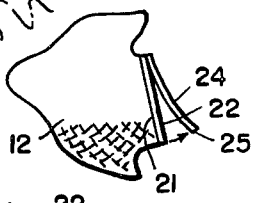
FIG. 6
FIG. 7
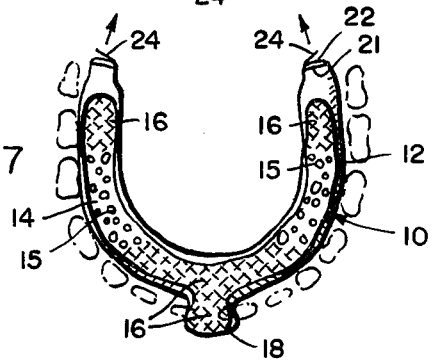

INTRA-ORAL FILTERING DEVICE

BACKGROUND OF THE INVENTION

In the past, respiratory devices for filtering and removing noxious material and fumes from atmospheric air have generally included a screen or filter material which when attached to the face of the user covers the mouth and nose of the user. Other respiratory devices have included a complex canister or container combination containing catalysts and filters which also must be worn on the face of the user. When desired, such devices have been provided with face masks, nose clips, goggles and complex tubing connecting the filter containers and the face mask. Also, there are certain mouth-held respirators having complex filtering components which extend outwardly from the mouth of the user.

However, such devices have found only limited application as occupational safeguards because they are difficult to use, are generally uncomfortable to wear and bulky in appearance. Moreover, such devices are expensive to manufacture, unsightly to the wearer and have often encountered problems wherein the saliva of the user penetrates the interior respirator device to destroy the efficiency thereof.

SUMMARY OF THE INVENTION

Accordingly, it is a primary object of the present invention to provide an intra-oral filtering device for filtering and removing noxious materials from the air during the breathing process.

It is another object of the present invention to provide an intra-oral filtering device for filtering and removing noxious materials from the air during the breathing process which is reliable in operation, simple in construction and inexpensive to fabricate.

It is a further object of the present invention to provide a disposable intra-oral filtering device for filtering and removing noxious materials from the air during the breathing process.

Briefly, a preferred embodiment of the intra-oral filtering device for filtering and removing noxious materials from the air during the breathing process according to the present invention includes a housing adapted to conform to the shape of the roof of the mouth. The housing, generally constructed of an acrylic resin material, defines a cavity portion therein. The cavity contains a filter material, such as fibrous or chemical filters, which filter the air to thereby remove contaminants, for example, hay fever pollen, smog, auto exhaust smoke, chemical dusts, industrial fumes and wastes, sewage wastes and the like. The housing includes also a mouth-piece portion, communicating with the cavity portion, that extends outwardly from the mouth of the user to provide an entrance for the air breathed by the user thereof and an exit portion, communicating with the cavity portion, located on the end opposite the mouth-piece portion. The exit portion includes an unidirectional valve covering the exit portion which permits filtered and purified air to pass out of the intra-oral filtering device and which prevents saliva and expelled (exhaled) air during the breathing process from entering and damaging the fibrous or chemical filter material contained in the intra-oral filter device.

In operation, the intra-oral filtering device is positioned in the roof of the user's mouth with the mouth-piece portion extending outwardly between the teeth and the lips of the user. Upon the inhalation of atmospheric air, the air passes into the mouth-piece portion, through the cavity containing filter material and exits the intra-oral device past the unidirectional valve to the rear portion of the user's mouth. Upon the exhalation of spent air by the user during the breathing process, the spent air either passes out through the nose or mouth of the user.

In a further embodiment of the present invention, the intra-oral filtering device housing is essentially of a horseshoe or U-shaped configuration, which includes first and second cavity portions. Located intermediate the ends of the horseshoe configuration is a mouth-piece portion, which communicates with each of the first and second cavity portions, and which extends outwardly from the mouth of the user. Each of the end portions of the horseshoe shaped housing includes exit openings, each communicating with the cavity portion, and each having an undirectional valve selectively engageable with the exit opening to permit filtered and purified air to pass out of the intra-oral device and which prevents saliva and expelled air from the breathing process from entering and damaging the operation of the intra-oral device.

BRIEF DESCRIPTION OF THE DRAWINGS

FIG. 1 is a perspective view of one embodiment of the present invention illustrating the position of the intra-oral filter device within the user's mouth;

FIG. 2 is a top plan view of the embodiment of the intra-oral filter device as shown in FIG. 1;

FIG. 3 is a cross-sectional view of the intra-oral filter device as shown in FIG. 2 and taken along the line 3—3;

FIG. 4 is a cross-sectional view of the intra-oral filter device as shown in FIG. 2 and taken along reference line 4—4;

FIG. 5 is an enlarged cross-sectional view of the exit opening and valve position during exhalation of spent air during the breathing process;

FIG. 6 is an enlarged cross-sectional view of the exit opening and valve position during the inhalation of air through the intra-oral filtering device during the breathing process; and FIG. 7 is a top plan view of a further embodiment of the intra-oral device in accordance with the present invention.

DETAILED DESCRIPTION

Referring now to the drawings in greater detail wherein like numerals have been employed throughout the various views to designate similar components, in FIGS. 1, 2, and 3 numeral 10 represents the intra-oral filter device or assembly for filtering the surrounding air of dust, pollen, fumes and other noxious materials. The intra-oral filtering device includes a housing 12 adapted to conform to the shape of the roof of the user's mouth. The housing may be composed of a myraid of materials, but it is preferably composed of an acrylic resin material because such a material posseses softness and taste-free properties and is especially adapted for dental-hygiene applications. The housing 12 defines a cavity or enclosure portion 14 therein, which cavity is filled with a filter material 15, such as a fibrous or chemical filter, as will hereinafter be described. The housing 12 includes also a mouth-piece portion 18 having an opening 19 (FIG. 1 and FIG. 3) therein, which opening communicates directly with the cavity portion 14 to provide an entrance for air breathed by the user during inhalation to pass into the intra-oral device of the present invention. Although it is not necessary for the practice of the present invention, it is contemplated that the mouth-piece portion 18 is preferably molded integral to the housing 12. However, it is within the scope of the present invention to provide a separate mouth-piece portion that matingly is engaged to the housing. The end of the housing 12 opposite the mouth-piece portion 18 includes an exit portion 21 having an exit opening 22 therein which communicates also with the cavity portion 14 to permit filtered and purified air to pass out of the intra-oral filtering device 10, as shown by the arrows in FIGS. 2 and 5. The arrows represent the path of travel of the air as it passes through the intra-oral filtering device. Selectively engageable with the exit opening 22 is a valve cover or membrane 24 preferably integrally molded to the housing 12, which acts as a unidirectional valve to permit filtered and purified air to pass out of the intra-oral filtering device and to prevent saliva and exhaled air during the breathing process from entering and damaging the fibrous or chemical filter material contained in the cavity portion 14. The valve cover 24 is in the open position (FIG. 6) wherein end 25 of the valve cover 24 is biased away from exit opening 24 when air is inhaled by the user and is in the closed position (FIG. 5) wherein valve cover 24 is in a sealing relationship with exit opening 24 when the expelled air is exhaled by the user during the breathing process.

The cavity portion 14 contains the fibrous or chemical filter material 15 which filters the air and removes contaminant therefrom. Preferably, the housing 12 includes additional screening and retaining material 16 positioned between the cavity portion 14 and the mouth-piece portion 18 and the exit portion 21 to retain the fibrous or chemical filter material within the cavity portion. The fibrous or chemical filter material may include a catalyst for converting carbon monoxide to carbon dioxide, activated carbon from removing vapors and gases and a filter material for removing particulate matter from the air being inhaled by the user. Thus, hay fever pollen, smog, auto exhaust, smoke, chemical dusts and gases and industrial fumes and waste may be effectively removed by the present invention.

Additionally, if desired, housing 12 may be provided with sealable opening 28 (FIG. 2) which permits the user to remove and replenish the filter material 15 in the cavity portion 14 as desired. However, sealable opening 28 is optional in the construction of the present invention and it is generally desirable to simply dispose of the filtering device when its filtering and purifying efficiency has been substantially reduced.

A further embodiment of the present invention is shown in FIG. 7. In such an embodiment, the intra-oral filtering device housing 12 is essentially of a horseshoe or U-shaped configuration, includes first and second cavity portions 14. Located intermediate the ends of the horseshoe configuration is a mouth piece portion 18, having an opening 19 which communicates with each of the first and second cavity portions and which extends outwardly from the mouth of the user. Each of the end portions of the horseshoe shaped housing 12 includes exit portions 21 having therein openings 22 each communicating with the cavity portion and each having a unidirectional valve 24 selectively engageable with the exit opening to permit filtered and purified air to pass out of the intra-oral device and which prevents saliva and expelled air from the breathing process from entering and damaging the operation of the intra-oral device, as disclosed with respect to the embodiment of the present invention shown in FIGS. 5 and 6.

In operation, the intra-oral filtering device shown in FIGS. 1–6 is positioned in the roof of the user's mouth, and the device shown in FIG. 7 may be adjustably positioned between the teeth and cheeks of the user. In both embodiments, the mouth-piece portion extends outwardly from the mouth of the user. Upon inhalation of atmospheric air, the air passes into the opening in the mouth-piece portion, through the cavity or cavity portions to exit past the end portion opening into the rear of the user's mouth. Upon exhalation, the spent air either passes out through the nose or mouth of the user.

What has been described is a simple and efficient intra-oral filtering device which provides healthful and clean air to the user thereof and which is esthetically desirable because the device is positioned within the user's mouth.

I claim:

1. An intra-oral device for filtering and removing noxious materials from the air during the breathing process, including in combination:

a U-shaped housing defining at least one cavity portion therein and having a mouth-piece portion located intermediate the ends of said housing, said mouth-piece portion having an opening therein for receiving unpurified air into said housing, said mouth-piece opening communicating with at least one of said cavity portions, said U-shaped housing having exit openings therein at each of the ends thereof, each of said openings further communicating with at least one of said cavity portions, filter means mounted in at least one of said cavity portions of said housing for filtering and removing noxious materials from the air passing through said filter means, and valve means mounted to said ends of said U-shaped housing and selectively engageable with each of the exit openings, said valve means being operable between an open position away from the opening to permit the exit of filtered air from said housing during inhalation and a closed position engaging the opening to prevent the entrance of spent air and saliva into said housing during exhalation.

2. The intra-oral device in accordance with claim 1 wherein said U-shaped housing is composed of an acrylic resin.

3. The intra-oral device in accordance with claim 1 wherein said U-shaped housing further includes a sealable opening therein for replenishing said spent filter means contained in at least one cavity portion.

4. The intra-oral device in accordance with claim 1 further including retention means positioned in said U-shaped housing between said mouth-piece portion and at least one cavity portion and between said exit openings and at least one cavity portion to confine said filtering means within at least one cavity portion.

* * * * *